US005904802A

United States Patent [19]

Niedermeyer

[11] Patent Number: 5,904,802

[45] Date of Patent: May 18, 1999

[54] METHOD AND APPARATUS FOR MAKING FRONT OPENING BRIEFS

[76] Inventor: William P. Niedermeyer, 1024 Mt. Mary Dr., Green Bay, Wis. 54311

[21] Appl. No.: 08/901,914

[22] Filed: Jul. 29, 1997

Related U.S. Application Data

[63] Continuation-in-part of application No. 08/598,368, Feb. 8, 1996, Pat. No. 5,795,433, and application No. 08/796,438, Feb. 10, 1997.

[51] Int. Cl.[6] ..... A41D 1/00; A41H 33/00; D05B 35/00

[52] U.S. Cl. ..... 156/479; 156/226; 156/227; 156/517; 156/520

[58] Field of Search ..... 156/475, 477.1, 156/479, 517, 520, 521, 212, 226, 227

[56] References Cited

U.S. PATENT DOCUMENTS

| | | |
|---|---|---|
| 3,689,061 | 9/1972 | Nystrand . |
| 3,823,935 | 7/1974 | Guichard . |
| 3,870,292 | 3/1975 | Bradley . |
| 4,003,775 | 1/1977 | Bott . |
| 4,055,859 | 11/1977 | Green . |
| 4,160,423 | 7/1979 | Scholl . |
| 4,266,112 | 5/1981 | Niedermeyer . |
| 4,289,493 | 9/1981 | Hedrich . |
| 4,316,756 | 2/1982 | Wilson . |
| 4,328,655 | 5/1982 | Spencer . |
| 4,347,955 | 9/1982 | Kamal . |
| 4,425,173 | 1/1984 | Frick . |
| 4,448,626 | 5/1984 | Off . |
| 4,549,916 | 10/1985 | Off . |
| 4,699,302 | 10/1987 | Papajewski . |
| 5,211,320 | 5/1993 | Hubele . |
| 5,795,433 | 8/1998 | Niedermeyer ..... 156/479 |

*Primary Examiner*—Daniel Stemmer

[57] ABSTRACT

The machine of the present invention fabricates briefs having an openable front panel from two continuous half width webs. The first and second web paths are transversely spaced. It includes feeding and folding devices to add a V-folded reinforcing strip along the edge of one web. Feeder and tensioning devices are included for elastomeric strands that shirr the briefs and to add a re-closable tape across the front panel opening. One of the webs is printed with adhesive at spaced intervals to bond portions of the two overlapped webs in central areas of overlap that become the rear panel after the web is cut into segments and transversely folded. The machine attaches components of the brief and cuts leg apertures and side flaps on each web while the advancing overlapped webs are continuous. After transfer to a rotary drum, the web is severed into overlapped segments which are then cross folded by drum elements before the flaps extending from each side are folded over to secure the back panel to the openable front panel. Another embodiment severs the web into segments before being transferred to the drum for final cross folding into front-rear panels and flap foldover to connect the panels together.

19 Claims, 5 Drawing Sheets

FIG. 9B
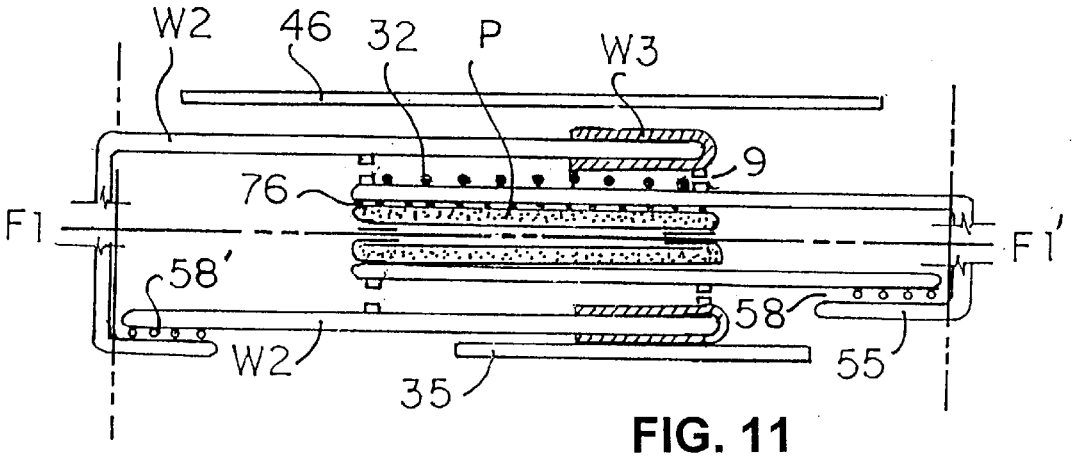
FIG. 10
FIG. 11
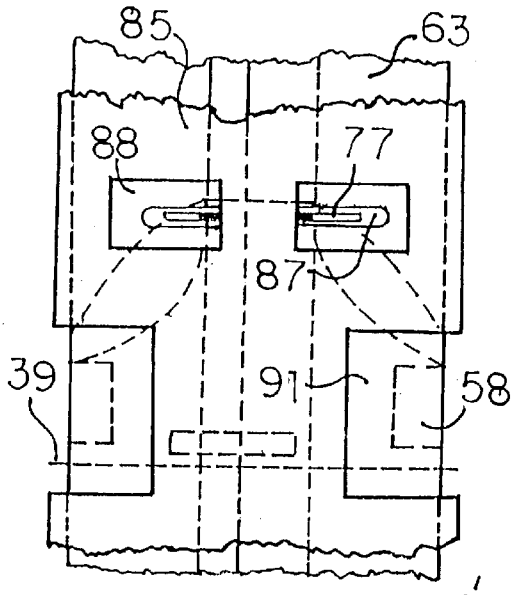
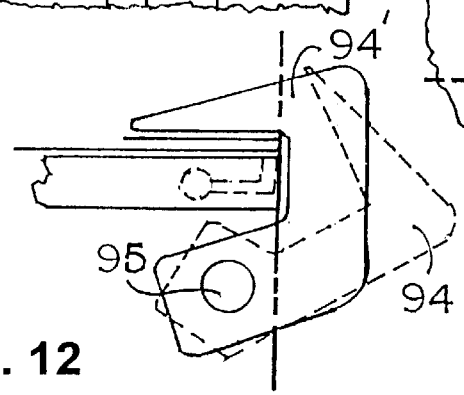
FIG. 12
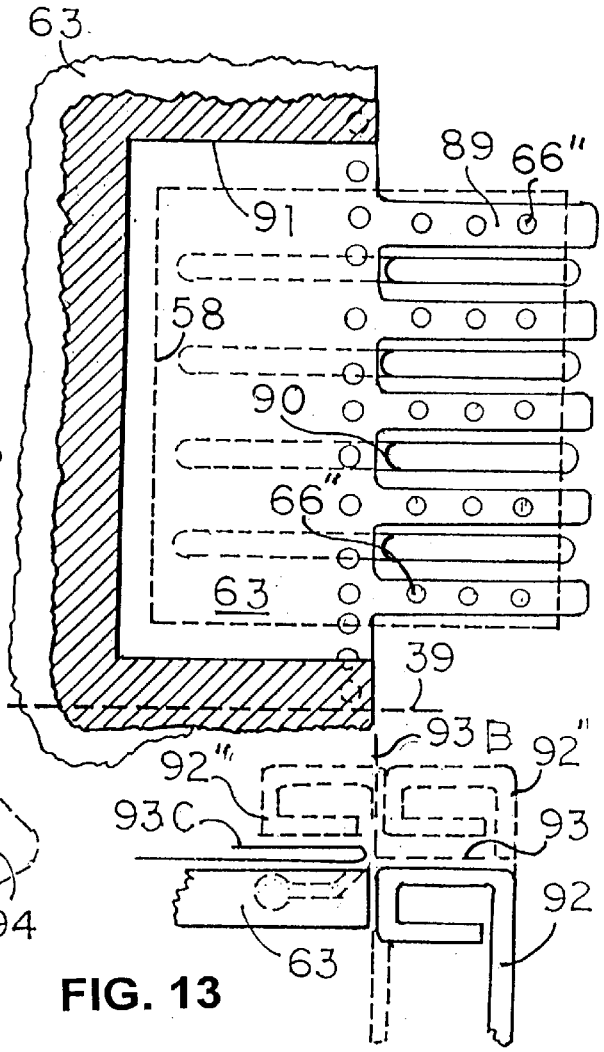
FIG. 13

80'
70'
50'
101
102
103
104
100
S
84'
96
16
63'
107
108
106
98
85'
55
58
80
76
85
63
87
77
109
109'
P
118
117
116
115
114
113
112
111
110

METHOD AND APPARATUS FOR MAKING FRONT OPENING BRIEFS

This invention describes apparatus and method for high speed manufacture of briefs with a front opening and is a continuation-in-part of U.S. application Ser. No. 08/598,368 filed Feb. 8, 1996 now U.S. Pat. No. 5,795,433 and co-pending application Ser. No. 08/796,438 filed Feb. 10, 1997.

BACKGROUND OF THE INVENTION

Patent '433 describes a rotary folding apparatus to make seams along selected margins of a shaped garment.

The '433 apparatus can be arranged to make longitudinal seams in the machine direction, transverse seams in the cross direction, and seams along margins at any angle.

Patent '433 also describes the use of mechanical fingers or air blast to fold extension flaps of an underlying segment over the margins of a superposed segment to entrap it within the folded seam.

To provide clearance for 'extraneous' devices used to fabricate special garment components such as shirt collars, etc., a shaped vacuumized bearing surface (platen) was defined. It is the functional equivalent of the term 'bearing surfaces' used in the description of this invention for manufacturing briefs.

Patent '433 describes the folding/seaming apparatus for garments having a front panel and a rear panel including front opening briefs made from two half width overlapped segments that are bonded together in spaced central areas of the trailing half segments to from a rear panel, later attached to the unbonded front panel after transverse folding.

In the preferred embodiment of this invention, a major portion of the fabrication and assembly occurs while the material is still in web form, before severing the almost completed briefs.

In another embodiment of this invention (see FIG. 14), the partially completed brief is cut into segments before transfer to the carrier drum.

In a modification of the preferred embodiment, the briefs can include an adhesively coated area covered with a release coated strip that is pulled off by the user for attachment of an absorbent pad of choice.

In another embodiment, the product can include an absorbent pad having features well defined in prior art.

Appartus described in U.S. Pat. No. 4,081,301 to Buell (Class 156). U.S. Pat. No. 3,828,367 to Bourgeois, U.S. Pat. No. 4,240,866 to Gore, and U.S. Pat. No. 4,300,967 to Sigh can be adapted to apply elastomeric bands to the briefs and/or the intergral pad so that components of the combination will contract equally when tension is relieved at cutoff.

SUMMARY OF THE INVENTION

The high speed operation and efficiency of state of the art disposable diaper manufacturing machines is well established and due largely to the fabrication of materials while they are still in web form.

Similar methods are used in this invention to fabricate briefs with a reclosable opening or 'fly' in the front panel.

The apparatus advances two webs, each of about half width of the product, and using 'reverse' folding plates to apply a reinforcing strip on one or more web edges, web paths are arranged to partially overlap.

The combined webs are advanced through various fabrication steps including adhesive printing of predetermined areas, adding a closure tape to connect non-bonded half segments of the front panel, with the result that a major portion of the product fabrication occurs while the material is in web form.

After severing the web into a series of product segments, transverse folding and subsequent folding of side flaps completes the product.

The primary object of the invention is to define apparatus for fabricating briefs with a reclosable opening.

Another objrct is to describe alternate methods and apparatus for making similar briefs.

Another object is to modify the primary machine to produce briefs that have adhesive areas to attach absorbent pads of the user's choice.

Other objects will be seen in the ensuing specification.

BRIEF DESCRIPTION OF THE DRAWINGS

FIG. 9B is a sectional view of the folded product viewed from line 9B—9B of FIG. 7.

FIG. 10 is a plan view of the carrier roll surface viewed from line 10—10 of FIG. 7.

FIG. 11 is an enlarged plan view similar to FIG. 10 illustrating flap extension support, folding fingers, and belt cutouts for flap folding.

FIG. 12 is a side view of rotary folding fingers mounted adjacent the flap folding carrier drum edge viewed in the direction of product movement.

FIG. 13 is a side elevation of reciprocating fingers for flap foldover viewed in the direction of product movement.

DETAILED DESCRIPTION

Figure 1:
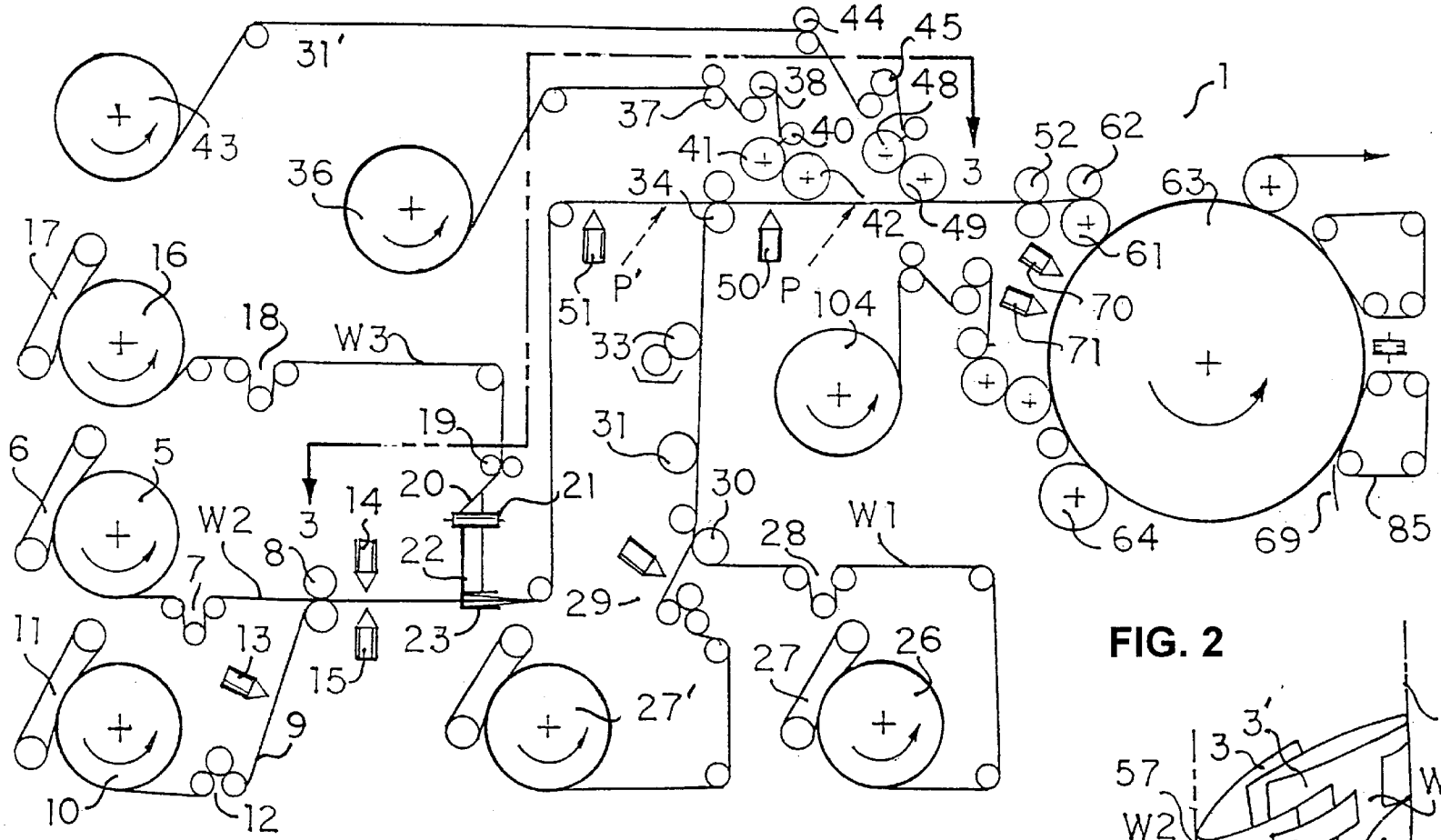
FIG. 1 is a schematic side elevation of apparatus to manufacture undergarment briefs with a front opening.
Figure 2:
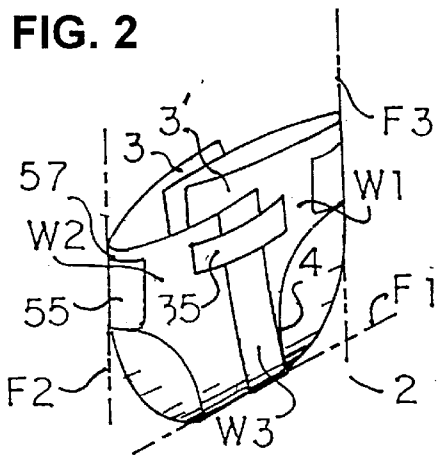
FIG. 2 is a perspective view illustrating the product.

In FIG. 1, manufacturing apparatus 1 substantially completes the briefs shown in FIG. 2 while materials are in web form, and completes the product after the web is transferred to a carrier drum.

While on the drum, the web is cut, segments are cross folded and side flap extensions are folded over and secured to complete the assembly.

FIG. 2 illustrates crotch fold line F-1 and side fold lines F-2 and F-3.

In FIG. 2 the left hand web portion W 2 is offset from the right hand portion W 1 resulting in overlap 3 which is bonded between rear portions (not shown) and is left unsealed as at 3' between front portions W 1 and W2 to produce the front panel opening 4 on front panel 2.

Referring again to FIG. 1, web W 2 is unwound from supply roll 5 by belt 6. Web W 1 and W 2 are also referred to first and second webs herein.

Web W 2 is advanced through a 3-roll constant tension system 7 by a set of pull rolls 8. Concurrently, a set of three coacting rolls 12 draw a pair of elastomeric bands 9 from supply roll 10.

Elastic bands 9 pass through the nip of S-wrap roll set 12 which are arranged to advance the elastic at a velocity lower than the velocity of web W 2 thus inducing tension in the elastic bands.

The elastic bands pass under a glue applicator nozzle 13 for subsequent spaced attachment under tension to web W 2 at the nip of roll set 8.

In FIG. 1, a narrow web strip W 3 is unwound from supply roll 16 by bets 17, pass through the nip of pull roll pair 19 mounted at the top of folding plate 20.

A second pair of draw rolls 21 at the tip of folding plate 20 have a variable speed drive (not shown) to create tension in the web strip moving over the folding plate. The apex of the folded web is along margin 22.

Figure 4:
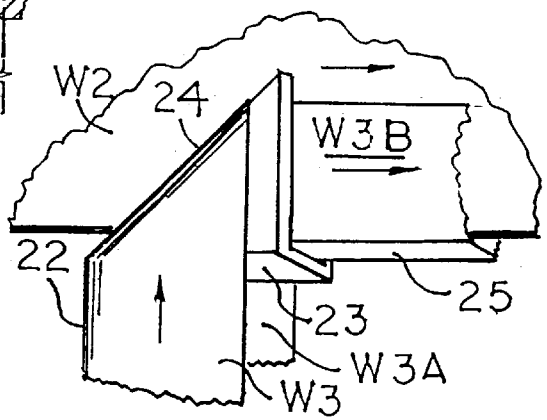
FIG. 4 is a perspective view of the 'double inverse' folding plates used in FIG. 3.
Figure 3:
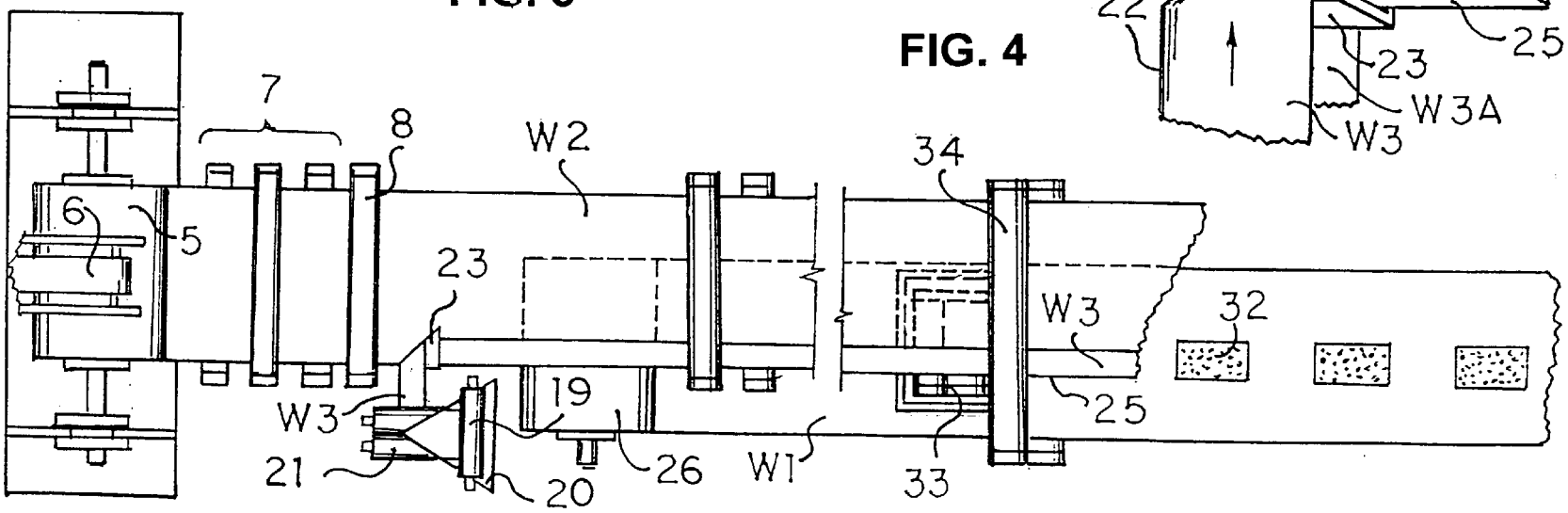
FIG. 3 is a plan view of the unwind stand arrangement for overlapping advancement of webs including means for folding a strip to reinforce one edge of one web.

Referring briefly to FIGS. 3 and 4, the V-folded web is advanced from pull rolls 19 (seen in FIG. 3) and is advanced over guide rolls (not shown) to the incoming web position W 3A,advanced over the top and bottom outside surfaces of inverse folding plates 23, around the 45 degree angled edges 24, and is reverse folded to slide over inside surfaces and exit from plate pair 23 with the web W 3B directed 90 degrees from the incoming web—in effect, a 90 right angle turn involving a reversal of inside and outside surfaces before and after the fold.

The apex of folded web W3B is along edge 25.

In FIGS. 3 and 4, the second web W 2 is shown entering the space between the reverse folded portions of strip W 3 and is enclosed therebetween.

The reinforcing strip W3 is attached to web W2 adhesive applied at 14 and 15 (see FIG. 1).

Spacing between the upper and lower angled plates 23 can be changed to increase spacing when W 2 spliced joints are sensed upstream, and can be reduced to smaller spacing using automatic controls (not shown).

It is further noted that while a strip reinforcing web is shown being added to one web, duplicate but oppositely handed means can be used to add a strip to web W1.

In FIG. 1 first web W 1 is concurrently fed from supply roll 26 by unwind belt 27 and passes through a 3-roll constant tension system 28.

With a system 29 similar to the elastic feed and tensioning apparatus described above for web W2, the elastic is tensioned and adhesive is applied at spaced intervals before it is attached at pull roll set 30.

Intermediate guide rolls like 31 can be grooved to contain adhesive offset to roll surfaces.

Before being joined to web W 2, the underlying web W 1 (see FIGS. 3 and 6) has adhesive applied to a restricted, spaced area 32 of the central overlapped region by printer 33. The spaced area 32 of adhesive (see right side of FIG. 3) joins the two half width webs into a full width web with bonded overlap for the rear panel, and by leaving a portion not printed (spaced areas), some of the unbonded overlap becomes the front panel opening.

It is noted that when the longitudinal dimension of the printed area exceeds 50%, a limited but beneficial bonding occurs between 2 plies of the front panel near the crotch.

In FIG. 1, web W 1 is advanced to the nip between roll set 34 and bondably joined in the spaced apart areas of 32 to overlapped web W2, including the reinforcing strip W 3 that encloses one margin.

Figure 6:
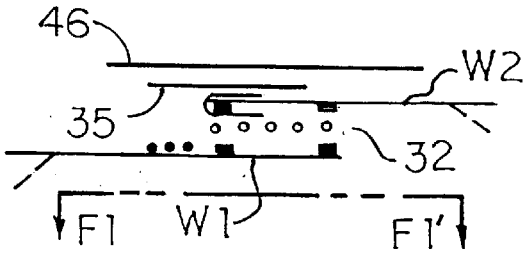
FIG. 6 is a sectional view of the web assembly viewed from line 6—6 of FIG. 5.
Figure 5:
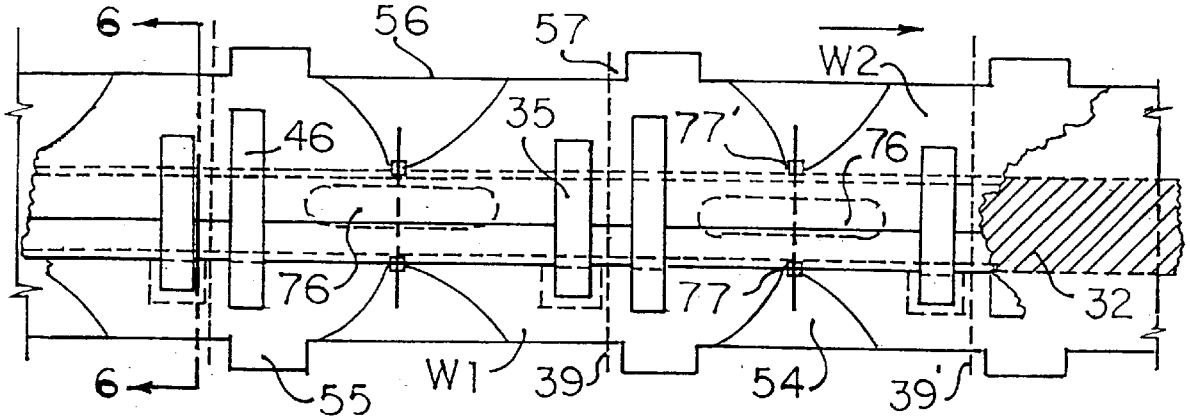
FIG. 5 is a plan view of the web assembly viewed from line 5—5 of FIG. 7 before transfer to the carrier drum surface.

In FIGS. 3, 5, and 6,the conjoined webs are viewed with web W 2 overlapped as the top web.

In other embodiments, webs can be interchanged.

Before reaching carrier drum 63, an openable closure tape (35 of FIG. 2) is attached to the top of web W 2 and extends over the folded edge of the reinforcing strip for attaching connection between the two half webs which, after subsequent folding, become the front panel.

In FIG. 1 (top left) a closure tape supply roll 36 is pulled by nip rolls 37 and threaded around S-wrap roll set 38. The web of tape 35 is flexible but non-extensible.

With a disc brake or equal means to provide resistance, web nip by roll set 37 and S-wrap rolls 38 induce enough tension to prevent overfeed while (for example), advancing a 1" long segment in the space between coacting rolls when the knife-anvils are not in contact between cuts. Roll 40 is a knife roll.

Vacuumized anvil roll 41 advances the tape segment to vacuum transfer roll 42 for transfer and extending attachment to web W 2.

In FIG. 1, a web of waistband material from supply roll 43 is likewise threaded over guide roll 31' into the nip of pulll rolls 44, and around S-wrap rolls 45 for segment cutoff and transfer by rolls 47, 48, and 49, as described in U.S. Pat. No. 3,728,191 and similar to many prior art tape feeding systems.

Figures 14, 15, 16, 17:
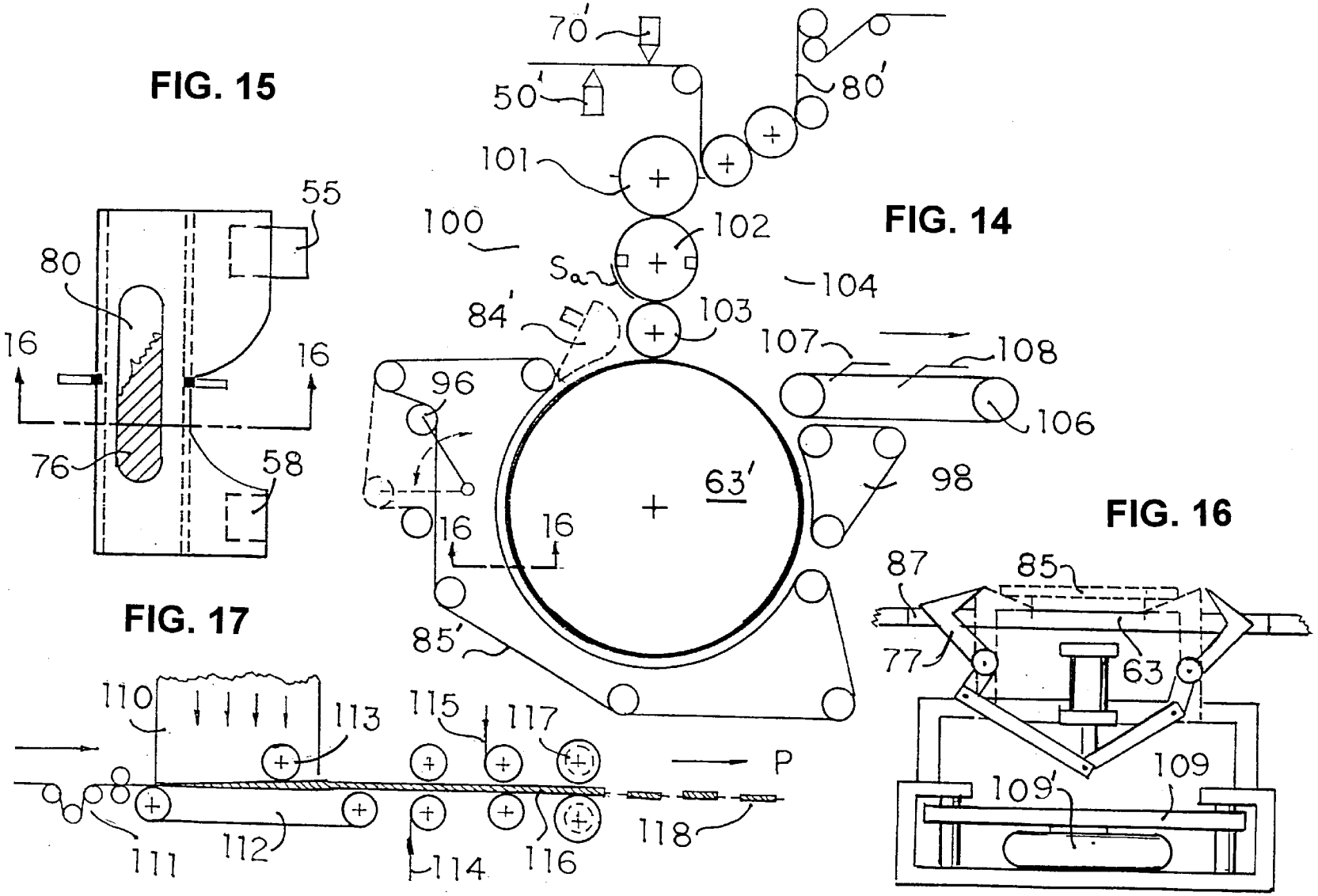
FIG. 14 is a side elevation schematic of an embodiment where the web is cut into segments prior to reaching the carrier roll surface.
FIG. 15 is a plan view of the web prior to cutting with a central area printed with adhesive and having a fragmentary portion of release strip attached.
FIG. 16 is an end elevation schematic view of the central area clamping means viewed from line 16—16 of FIG. 15.
FIG. 17 is a simplified side elevation illustrating typical fluff absorbent pad making apparatus that can be added to make briefs with an intergral pad.

In FIG. 1, an absorbent pad P and P' of conventional design can be manufactured by upstream apparatus (typical apparatus is shown in FIG. 17) and included as an integral part of the product.

In this instance, an adhesive receptor area is printed by applicator 50 to the inside surface of ply W 1 and the pad introduced along dashed arrow P.

In another embodiment, the receptor area is printed on web W2 by applicator 51 and the pad is added along arrow P'.

After tapes, waistbands, etc., are added, the overlapped webs (adhesively bonded between plies of the rear panel and tape connected on the front panel), pass through the nip between coacting die cutting roll 52 and anvil roll 53 to shape typical leg cutouts 54 and extension flaps 55 in the web assembly shown in FIG. 5 being supported by conveyor belt 56 (56 not shown in FIG. 1).

Referring briefly to FIG. 2, side flap extensions 55 are folded over and connect the rear panel to the front panel to form the leg apertures and the waist encircling aperture.

In both FIGS. 2 and 5, space 57 is provided between flaps 55 and lines of severence 39, 39' etc.,to avoid fouling of the cutting knives and anvils. Die roll 52 is designed accordingly.

Figure 8:
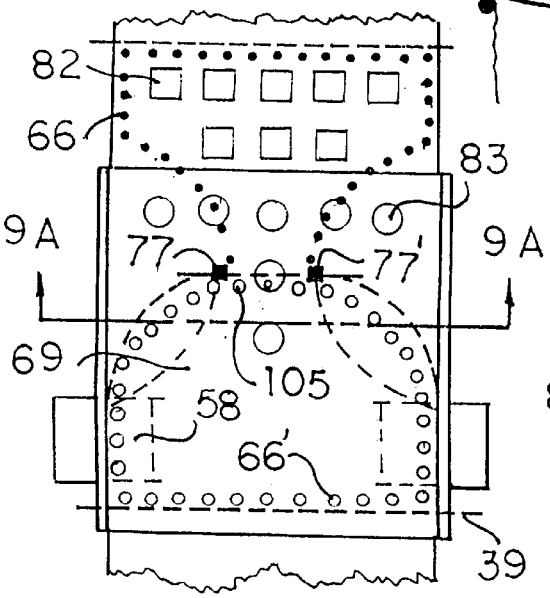
FIG. 8 is a plan view of the stationary folding guide viewed from line 8—8 of FIG. 7.

Flap 55 is folded and superposed on adhesively coated flap receptor area 58 (see bottom of FIG. 8).

Figure 7:
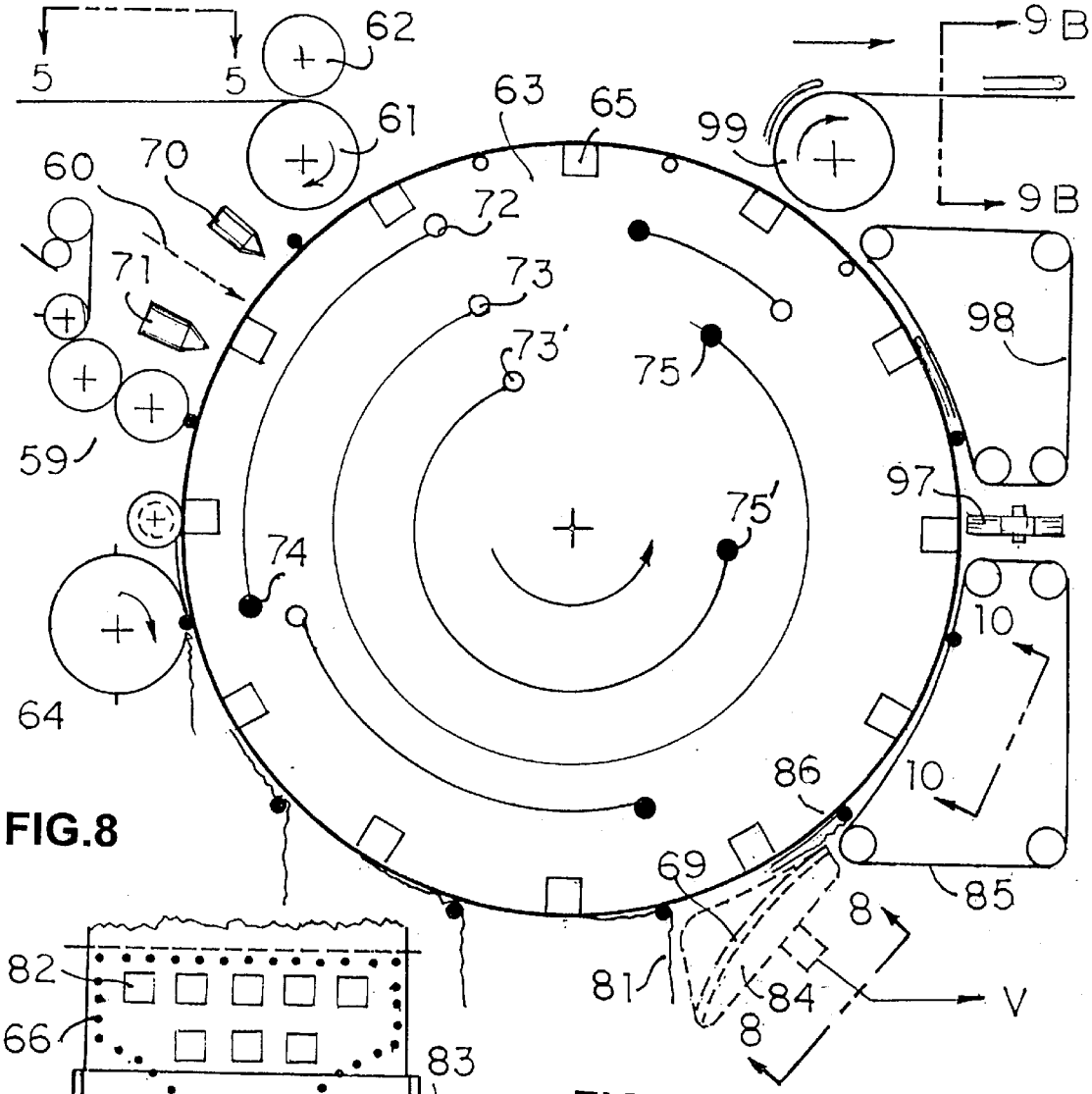
FIG. 7 is a schematic side elevation illustrating the functional sequence for the folding/seaming carrier drum of FIG. 1, including a coacting segment cutting roll.

In FIG. 5 the ovular shaped adhesive receptor area 76 (shown in FIG. 5) is applied by nozzle 71 before cutting the web into segments, and cover strip 80 (FIG. 15) is applied immediately thereafter by cover strip feed, cutoff, and transfer system 59 (see FIG. 7). The cover strip is peeled away by the user to place a pad of choice on the exposed adhesive area.

The product outline illustrated in FIG. 5(with front and rear panels) is representative of the product seen on the surface of carrier drum 63 when viewed in the direction of arrow 60 (see top left side of drum in FIG. 7).

The product is advanced around vacuum transfer roll 61 to the surface of carrier drum 63. A nip roll 62 cooperates with roll 61 to isolate incoming web tension.

With reference to FIG. 7, the carrier drum 63 provides a (counterclockwise rotating) bearing surface for support of the substantially completed product while it is in web form. Carrier drum 63 functions as a vacuumized support surface for the uncut web during the first 90 degrees of rotation during which several final fabricating steps are performed before cutting the web into segments.

The incoming web (and cut segments) are held against the drum surface by vacuumized ports 66 (shown solid in FIG. 8) under the web in registration with the front panel portion, and ports 66' (shown circular) under the web in registration with the rear panel portion. Each successive product has the same pattern of ports shown in FIG. 8.

In FIG. 7,a pair of glue applicators 70, 70' apply adhesive to side flaps 55 supported by finger-like protrusions 89 extending outwardly from the drum (see FIG. 11).

Protrusions 89 have vacuum apertures 66" to overcome windage that could disrupt the extended flaps from horizontal orientation as the drum rotates, thus, as the flap rotates past the nozzles 70, adhesive is applied to the unfolded surface and remains in position until flap folding occurs in the third quadrant of drum rotation (described later).

In the schematic illustration of FIG. 7, annular grooves are shown as vacuum or air channels as part of a vacuum valve means which controls the start and stop positions, duration of vacuum or air blast, etc. By this means, air or vacuum can be applied to any grouping of ports at any rotational location. For brevity, valves are not described herein, but are well known and described in detail in the earlier applications.

In FIG. 7, just before the web is transferred to the drum surface, vacuum starts at positions 72 and 73 and is applied separately to the pattern of front panel ports 66, and to the grouping of rear panel ports 66'.

Since the leading front panel is folded over the rear panel, the duration and timing of vacuum is different. Front panel vacuum is stopped when cutoff occurs as at 74, but rear panel vacuum stays on until position 75 before folded product exits from the drum.

Vacuum for the flap support fingers 89 of FIG. 11 starts at 73' and when the flap is folded, as at 75' in FIG. 7.

The general sequence of steps illustrated in FIG. 7 is tabulated below. The sequence is based on the product as described, but it is within the scope of this invention to modify sequence and location of apparatus components without departing from the basic teaching of manufacturing briefs with a front panel opening.

| CCW Degrees | Function |
|---|---|
| 360 | Reference |
| 340 | Front & rear panel vacuum start |
| 323 | web transfer to drum |
| 322 | grippers start up |
| 320 | adhesive for pad receptor area panel |
| 315 | grippers up |
| 310 | grippers start inward |
| 305 | adhesive applied for side flaps |
| 285 | add cover strip over pad adhesive |
| 284 | grippers in and engaged |
| 275 | web tension isolator roll |
| 260 | transverse cut web into segments |
| 255 | front panel vacuum stops |
| 250 | front panel air blast starts |
| 165 | front panel air blast stops |
| 160 | start of folding guide 90 |
| 150 | folding fingers start up (force 1) |
| 135 | folding fingers inward (force 2) |
| 120 | fingers 'dither' vertically |
| 110 | fingers start outward |
| 095 | fingers start down |
| 088 | brush roll operative |
| 085 | pressure belt over flaps |
| 075 | grippers start to open |
| 045 | grippers open and down |
| 040 | exit air blast start |
| 038 | belt pressure ends |
| 037 | rear panel vacuum stops |
| 035 | exit transfer point |
| 025 | exit air blast stops |
| 024 | grippers and fingers below drum surface |
| 000 | reference at 360 start of cycle |

In FIG. 7, nozzle applicator 71 applies adhesive to the receptor area pad P (see FIG. 15).

The width of central receptor area 76 is limited to avoid interference with gripper fingers 77 which move from below the drum surface (shown as open circles, as at position 78), and protrude as at position 79 (shown solid)

Numeral 59 refers to the segment advancing, cutting and transfer system that adds cover strip 80 (FIG. 15) over the pad adhesive 76 applied by nozzle applicator 71.

Rolls 61 and 64 are relieved to allow passage of protruding grippers.

At about 255 degrees, anvils 65 (referenced at 360 degrees) coact with knife roll 64 to cut transverse line 39–39'. Beyond this point, segments are held by rear panel vacuum ports 66' and grippers at the narrow central section as illustrated by 77 and 77' in FIG. 8.

The unrestrained front panel 81 (bottom of drum) is dislodged from the drum surface by an air blast through apertures 82 (shown square to differentiate from apertures 83 in FIG. 8).

In FIG. 7, just past 180 degrees, at position 81, the front panel is hanging down as it enters a sloped folding guide 69. Clearance between guide 69 and the drum surface decreases as the product advances.

Sloped guide plate 69 urges the free front panel closer to the drum surface and into superposed relationship with the vacuum held rear panel.

FIG. 8 is a plan view of the sloped folding guide 69 viewed from sight line 8—8 in FIG. 7. In FIG. 8 plate 69 has a plurality of evenly dispersed apertures 83 which communicate with vacuum plenum 84 (removed from FIG. 8 for clarity).

The side elevation of FIG. 7 shows the attached plenum 84 and a connection V to an outside vacuum source.

Figure 9A:
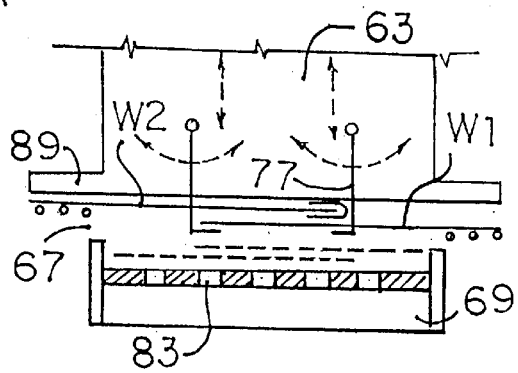
FIG. 9A is a sectional illustration of the overlapped webs looking in the direction of carrier roll rotation viewed from line 9A—9A of FIG. 8.

FIG. 9A also has the plenum removed, with apertures 83 in plate 69 are shown. In FIG. 9A flaps extending beyond the edges of drum 63 advance through space 67 between the folding guide and the drum surface for foldover under belt system 85 of FIG. 7.

Referring again to FIG. 7, the product at position 81 is gripped at the fold line F1–F1' with the rear panel held against the drum surface by vacuum, and the front panel is pulled across the inside surface of plate 69.

With vacuum applied to apertures 83, plate 69 provides a sliding resistance that tends to minimize shirring of the front panel as it passes through. When gripers 77 reach position 86, the trailing rear panel is still held by vacuum, and as the leading folded edge of the front panel is nipped and compressed by belt 85, minimum space between the folding guide 69 and the entrance to belt system 85 insures that as the leading portion of the front panel reaches belt 85, front panel portions nearer the cut margin are still being slidably restrained by vacuum apertures 83 in plate 69.

In FIG. 10, drum 63 is shown below belt 85. The drum has slots 87 in the surface that permit transverse movement of grippers 78 (shown closed and gripping).

Since the grippers function above the drum surface, cutouts 88 in belt 85 provide clearance for gripper movement.

As described earlier, extended flaps are supported by vacuumized drum protrusions 89, while passing under folding guide 69 through gap 67 (see FIG. 9A).

FIG. 11 shows a plurality of folding fingers 90 arranged in spaces between support fingers 89. To provide clearence above the drum surface, cutouts 91 on each side of belt 85 permit unobstructed movement of fingers to fold the flap 55 to folded position 58 (see FIG. 9B).

FIG. 13 illustrates the folding action of these fingers as they progress from position 92 to 92' to fold the flap 93 upward to 93*b* (first force), and finger movement from 92' to 92" to fold the flap to position 93*c* (second force).

FIG. 12 illustrates a rotary finger that provides the first and second folding forces as rotary urging forces rotate from position 94 to 94' on axis 95.

It is noted that stationary (non-rotating preferred) or rotating air nozzles can be substituted to produce either the first or second folding forces described.

Belt systems 85 of FIG. 11 and 85' of FIG. 14 have a pivotable belt compensator roll 96 (see FIG. 14) or other drive means to keep cutouts 91 in register with support fingers 89.

Side folds are brushed at roll position 97 (FIG. 7), then the product enters compression belt system 98 which extends to close proximity with exit transfer roll 99.

In FIG. 9B the component arrangement above fold line F1–F1' is exactly the same as FIG. 9A, and after folding is shown with mirror image components below the fold line, now with flaps attached as at 58, 58'.

FIG. 14 illustrates another embodiment 100 where the web assembly W a is cut into segments by a set of coacting cutoff rolls 101, 102 before transfer to carrier drum 63' via roll 103.

Like the preferred embodiment of FIG. 1, this arrangement includes the applicators 70' for adhesive to attach a cover strip over pad adhesive previously applied to web W a.

A cover strip advancing, cutting, and transfer system 104 applies release coated strip 80 over the exposed adhesive (see FIG. 15).

After cutoff by rolls 101 and 102, segment Sa is advanced around vacuum transfer roll 103. Vacuum ports in roll 103 carry the leading edge upward from the nip between roll 103 and carrier drum 63'.

Vacuum ports 105 adjacent fold line 77–77' (see FIG. 8) hold the product midway between end cuts, and the trailing portion of V-folded assembly is held against the surface of cylinder 63' and as the product is advanced, strips the leading first portion from roll 103 as the drum rotates.

In FIG. 14, folding of side flaps occurs under belt system 85' having cutouts for side fingers etc., as shown in FIG. 11, and compression belt system 98' before transfer from the drum to a special folding arrangent 106–108 as shown.

In FIG. 14, after the product exits from drum 63', the product is transported by vacuum belt 106 past a first folding rod 107, to fold a side panel over a central panel, and sequentially, a second foldng rod 108 folds the other side panel over the central panel and superposed first panel.

FIG. 16 shows the grippers used in the folding sequence of FIG. 7.

The shell of drum 63 has transverse slots 87 (see also FIG. 10) to allow transverse movement when the grippers clamp the product to the surface of drum 63.

For other rolls or coacting elements that cannot be relieved the gripper fingers 77 are mounted on a vertically slidable framework 109.

Pneumatic actuator 109' for upward motion can be rapidly charged and purged for downward spring return downward (springs not shown).

FIG. 17 is a conventional adsorbent pad making apparatus that makes and delivers pads P for placement in the direction of the (phantom) arrow shown in FIG. 1.

Fluff particles 110 decend from pulp grinders mounted above, and are deposited on a pervious carrier web 111 and advanced by vacuum belt 112. A 'scarfing' roll 113 controls fluff thickness.

An impervious barrier web 114 and a liquid permeable top web 115 are adhesively bonded to enclose the fluff web 116.

The assembled absorbent pad web is cut to length in roll set 117 to produce absorbent pad 118, also identified as P in FIG. 1.

It is furthermore to be understood that the present invention may be embodied in other specific forms without departing from the spirit or special attributes, and it is, therefore, desired that the present embodiments be considered in all respects as illustrative and therefore, not restrictive, reference being made to the appended claims rather than to the foregoing description to indicate the scope of the invention.

Having thus described the invention, what is claimed as new and desired to protect by Letters Patent are the following:

1. Apparatus for fabricating briefs having a reclosable opening in the front panel, said apparatus including:

means to position first and second web supply rolls on transversely spaced apart centerlines, said first and second webs each having a width substantially equal to one half the product plus an amount for overlap, means to advance said first web along a first path, means to advance said second web along a second path, means to apply bonding agent to selected areas of said first web, means to superpose said second web and said first web in partially overlapped relationship along a conjoined path, means to bond spaced apart overlapped areas of said first web to said second web, means to attach a fastener adjacent a transverse line of severance to connect said first and second webs forming a web assembly, means to cut leg apertures and shaped side flap extensions along side margins of said overlapped first and second webs, means to apply a bonding agent to receptor areas adjacent side margins of said first and second webs, a carrier drum moving in a path having a beginning and an end, means to advance said overlapped webs to said carrier drum surface, an external vacuum source communicating with apertures in the surface of said carrier drum and timing valves to activate and deactivate vacuum, vacuum means on said carrier drum to secure said web assembly to said carrier surface midway between lines of severance, means on said carrier drum and on a coacting roll to sever said web assembly into a series of segment assemblies comprised of two overlapped half width segments, means on said carrier drum to transversely fold the leading half portion of said segment assembly into superposed relationship with the trailing half portion of said segment assembly to form respectively, a front panel assembly having an overlapped opening, and a rear panel assembly comprised of two overlapped half width segments bonded in a central overlapped area, means on said carrier drum to fold said side flaps extending from said bonded rear panel assembly and secure said flap to said front panel assembly, means to remove said folded segment assembly from said carrier drum path.

2. The apparatus of claim 1 further including means to apply bonding agent to both sides of at least one of said first or second incoming webs along a marginal edge remote from said overlapped area, and means to advance and fold a third V-folded strip web around a side margin of said web.

3. The apparatus of claim 1 wherein said carrier drum includes gripper means to urge a central portion of said segment assembly toward said carrier drum surface during a selected portion of a revolution.

4. The apparatus of claim 1 wherein said carrier drum includes means to apply a radially outward first force and a second force means to fold the leading front half portion of said segment assembly over said trailing half portion along a transverse line.

5. The apparatus of claim 4 wherein said second force means is mounted fixed relative to said rotating carrier drum.

6. The apparatus of claim 4 wherein said first force means is pressurized air.

7. The apparatus of claim 1 wherein said carrier drum includes first force means to fold side flaps from extended orientation parallel to the drum surface to an orientation substantially perpendicular to the carrier drum surface, and a second force means to fold said flaps around side margins of both superposed front and rear panels of said segment assembly.

8. The apparatus of claim 1 wherein said carrier drum includes a radially outward air blast to urge the folded segment assembly away from the surface of said carrier drum for transfer to subsequent operations in said path.

9. The apparatus of claim 1 including a means to advance the folded segment assembly along a path including means to apply a first force in a direction perpendicular to the plane of advancement and means to apply a second folding force in a plane parallel to the plane of advancement to overfold one side portion over said centrally overlapped area and additional means to apply first and second forces to fold the other side portion over the folded first side portion before removal of the product from said carrier path.

10. The apparatus of claim 4 wherein at least one of the force means is pressurized air applied through apertures in said carrier drum.

11. The apparatus of claim 1 wherein the carrier drum includes;

means to grip a segment assembly during a portion of a revolution, first force means to urge the side margin flap extensions of said first trailing half portion perpendicular to the carrier drum surface and, a second force means to fold said flaps over said leading half portion being held against said carrier drum surface by belt means.

12. The apparatus of claim 11 wherein a belt means holds said folded segment assembly against said carrier drum surface and includes cutouts of the belt above said gripping means and above said first and second force means locations for folding side flap extensions.

13. The apparatus of claim 12 wherein a plurality of fingers are aligned along an axis substantially parallel to the direction of product movement, said fingers including means to apply said first and second folding forces.

14. The apparatus of claim 1 wherein said means to cut leg apertures and shaped side flap extensions along side margins is arranged to space the nearest edge of said side flap extensions from a line of severance between products.

15. Apparatus for fabricating briefs having a reclosable opening in the front panel, said apparatus including:

means to position first and second web supply rolls on transversely spaced apart centerlines, said first and second webs each having a width substantially equal to one half the product plus an amount for overlap, means to advance said first web along a first path, means to advance a second web along a second path, means to apply a bonding agent to selected areas of said first web, means to superpose said second web and said first web in partially overlapped relationship along a conjoined path, means to bond spaced apart overlapped areas of said first web to said second web, means to attach a fastener adjacent a transverse line of severance to connect said first and second webs forming a web assembly, means to cut leg apertures and shaped side flap extensions along side margins of said overlapped first and second webs, means to apply a bonding agent to receptor areas adjacent side margins of said first and second webs, a carrier drum moving in a path having a beginning and an end, means to advance said overlapped webs to said carrier drum surface, an external vacuum source communicating with apertures in the surface of said carrier drum and timing valves to activate and deactivate vacuum, vacuum means on said carrier drum to secure said web assembly to said carrier surface midway between lines of severance, means to transversely sever said web assembly before transfer to said carrier drum into a series of segment assemblies comprised of two overlapped half width segments, means on said carrier drum to transversely fold the leading half portion of said segment assembly into superposed relationship with the trailing half portion of said segment assembly to form respectively, a front panel assembly having an overlapped opening, and a rear panel assembly comprised of two overlapped half width segments bonded in a central overlapped area, means on said carrier drum to fold said side flaps extending form said bonded rear panel assembly and secure said flap to said front panel assembly, and means to remove said folded segment assembly form said carrier drum path.

16. A method of making undergarment briefs having an openable front panel including the steps of:

providing first and second webs, aligning said webs on spaced centerlines to create overlap in a longitudinal central region, advancing said first web and applying a bonding agent to a longitudinally spaced central area of said web, advancing and superposing said second web and said first web in said central overlapped area, bonding said first and second webs in said longitudinally spaced areas to form a web assembly, advancing, cutting and placing a fastener to connect the unbonded portions of said overlapped webs at selected locations near a line of transverse severance, cutting a curvilinear shape including leg apertures and side flap extensions along non-overlapped margins of the conjoined web assembly, transferring said web assembly to a carrier drum having a beginning and an end, transversely cutting said web assemblies into a series of segment assemblies, transversely folding the leading portion of said segment assembly over the trailing portion of said segment assembly, folding extended portions of the underlying segment of said assembly over the edge of said second segment and securing said extended portion to said second segment, removing the transversely folded, assembled undergarment from said carrier drum path.

17. The method of claim 16 whereby said web assembly is transversely cut into segments before being transferred to said carrier drum path.

18. The method of claim 16 wherein said first web is superposed on top of said second web.

19. The method of claim 16 whereby said web assembly is transversely cut into segments after being transferred to the carrier drum.

* * * * *